US008646997B2

(12) United States Patent
Matsubayashi et al.

(10) Patent No.: US 8,646,997 B2
(45) Date of Patent: Feb. 11, 2014

(54) INK RIBBON CASSETTE

(75) Inventors: Hideki Matsubayashi, Okayama (JP); Hidemasa Kaida, Tokorozawa (JP); Yoshihiro Sawa, Charlotte, NC (US); Kazunobu Imoto, Okayama (JP); Naohiro Obonai, Nagareyama (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 1018 days.

(21) Appl. No.: 12/306,588

(22) PCT Filed: Jul. 18, 2007

(86) PCT No.: PCT/JP2007/064155

§ 371 (c)(1),
(2), (4) Date: Dec. 24, 2008

(87) PCT Pub. No.: WO2008/010507

PCT Pub. Date: Jan. 24, 2008

(65) Prior Publication Data

US 2009/0285615 A1 Nov. 19, 2009

(30) Foreign Application Priority Data

Jul. 18, 2006 (JP) ..... 2006-195584

(51) Int. Cl.
*B41J 35/28* (2006.01)

(52) U.S. Cl.
USPC ..... 400/208; 400/207

(58) Field of Classification Search
USPC ..... 400/207, 208, 208.1
See application file for complete search history.

(56) References Cited

U.S. PATENT DOCUMENTS

| | | | | |
|---|---|---|---|---|
| 4,556,691 | A * | 12/1985 | Castelein | 525/71 |
| 4,676,678 | A | 6/1987 | Watanabe | |
| 5,547,298 | A * | 8/1996 | Wouters et al. | 400/692 |
| 5,730,310 | A * | 3/1998 | Yoshihara | 220/835 |
| 5,984,546 | A | 11/1999 | Kameyama | |
| 6,369,160 | B1 | 4/2002 | Knoll et al. | |

FOREIGN PATENT DOCUMENTS

| | | |
|---|---|---|
| EP | 0 852 183 A2 | 7/1998 |
| EP | 1 095 783 A2 | 5/2001 |
| JP | 57-030747 | 2/1982 |

(Continued)

OTHER PUBLICATIONS

English translation of JP 2005047222 A.*

(Continued)

*Primary Examiner* — Christopher Stanford
(74) *Attorney, Agent, or Firm* — Burr & Brown, PLLC

(57) ABSTRACT

An ink ribbon cassette is provided with a shaft container including a reel-out shaft holder having a reel-out shaft bearing journaling an ink ribbon reel-out shaft; a reel-in shaft holder having a reel-in shaft bearing journaling an ink ribbon reel-in shaft; and a pair of lateral bodies connecting the reel-out shaft holder to the reel-in shaft holder. A reel-out shaft holder cover 19 adapted to cover the reel-out shaft holder of the shaft container is connected to the reel-out shaft holder via a first connecting body. A reel-in shaft holder cover adapted to cover the reel-in shaft holder of the shaft container is connected to the reel-in shaft holder via a second connecting body. The first and second connecting bodies and have two or more hinges.

11 Claims, 9 Drawing Sheets

(56) References Cited

FOREIGN PATENT DOCUMENTS

| | | | | | |
|---|---|---|---|---|---|
| JP | 02-130357 | U1 | | 10/1990 | |
| JP | 04-050259 | A1 | | 12/1992 | |
| JP | 08-072348 | | | 3/1996 | |
| JP | 09-136464 | A1 | | 5/1997 | |
| JP | 10-193760 | A1 | | 7/1998 | |
| JP | 2001-080148 | A1 | | 3/2001 | |
| JP | 2002-506106 | | | 2/2002 | |
| JP | 2005-047054 | | | 2/2005 | |
| JP | 2005-047222 | | | 2/2005 | |
| JP | 2005047222 | A | * | 2/2005 | ..... B41J 17/32 |
| WO | 95/09777 | A1 | | 4/1995 | |
| WO | 99/46330 | A1 | | 9/1999 | |

OTHER PUBLICATIONS

Japanese Office Action, Japanese Application No. 2007-187020, dated Feb. 10, 2012 ( 6 pages).

Korean Office Action (With English Translation), Korean Patent Application No. 10-2009-7001375, dated Aug. 2, 2013 (6 pages).

* cited by examiner

INK RIBBON CASSETTE

FIELD OF THE INVENTION

The present invention relates generally to thermal transfer ink ribbon cassettes and particularly to a small-sized ink ribbon cassette whose hinge portion does not project outwardly.

BACKGROUND OF THE INVENTION

In general, ink ribbon cassettes having thermal transfer ink ribbons are widely used in printing equipment such as a printer or the like. A thermal head of a printer abuts against an ink ribbon to thermally transfer the dye and pigment of the ink ribbon to a sheet superposed on the ink ribbon for printing. During printing, such a thermal transfer ink ribbon is supplied from an ink ribbon reel-out shaft of a reel-out shaft holder of the ink ribbon cassette and reeled in around an ink ribbon reel-in shaft of a reel-in shaft holder of the ink ribbon cassette.

More specifically, with reference to FIG. 9, a conventional ink ribbon cassette 30 is provided with a shaft container 41. This shaft container 41 includes a reel-out shaft holder 37, a reel-in shaft holder 39 and a pair of lateral bodies 33. The reel-out shaft holder 37 has a reel-out shaft bearing 31 that journals an ink ribbon reel-out shaft 35 winding an ink ribbon 34 therearound. The reel-in shaft holder 39 has a reel-in shaft bearing 32 that journals an ink ribbon reel-in shaft 36 securing one end of the ink ribbon 34. The lateral bodies 33 connect the reel-out shaft holder 37 with the reel-in shaft holder 39. A reel-out shaft holder cover 38 and a reel-in shaft holder cover 40 are each provided separately from the shaft container 41. The reel-out shaft holder cover 38 is adapted to cover the reel-out shaft holder 37 of the shaft container 41. The reel-in shaft holder cover 40 is adapted to cover the reel-in shaft holder 39 of the shaft container 41.

In order to manufacture the ink ribbon cassette 30, the shaft container 41, the reel-out shaft holder cover 38 and the reel-in shaft holder cover 40 are molded separately from one another by an injection die. Thereafter, the reel-out shaft holder cover 38 and the reel-in shaft holder cover 40 are manually assembled to the shaft container 41.

In this case, the reel-out shaft holder cover 38 and the reel-in shaft holder cover 40 are provided with fitting members 38*a* and 40*a*, respectively, as shown in FIG. 9. When the reel-out shaft holder cover 38 is assembled to the shaft container 41, the fitting members 38*a* of the reel-out shaft holder cover 38 are internally snap-engaged with the reel-out shaft holder 37 of the shaft container 41. Similarly, when the reel-in shaft holder cover 40 is assembled to the shaft container 41, the fitting members 40*a* of the reel-in shaft holder cover 40 are snap-engaged with fitting apertures in the reel-in shaft holder 39 of the shaft container 41.

In this case, as shown in FIG. 9, the fitting members 38*a* of the reel-out shaft holder cover 38 are provided inside the reel-out shaft holder cover 38 and similarly also the fitting members 40*a* of the reel-in shaft holder cover 40 are provided inside the reel-in shaft holder cover 40. Therefore, when the reel-out shaft holder cover 38 and the reel-in shaft holder cover 40 are assembled to the shaft container 41, the shaft container 41 has no portion projecting outwardly from a front surface 37*a* of the reel-out shaft holder 37 and from a front surface 39*a* of the reel-in shaft holder 39.

After the reel-out shaft holder cover, the reel-in shaft holder cover (hereinafter, these are also simply called the covers) and the shaft container have been assembled with each other, a drop test is generally performed to confirm the strength of the assembled ink ribbon cassette by dropping it. This drop test requires the covers and the shaft container not to be disengaged from each other when the ink ribbon cassette is dropped from a certain height.

In order to pass the drop test, a preliminary drop test is performed using an ink ribbon cassette made by assembling the reel-out shaft holder cover, the reel-in shaft holder cover and the shaft container with each other. The respective shapes of injecting dies used to mold the covers and shaft container, especially, the respective shapes of the fitting members and fitting apertures (hereinafter, these are collectively called the fitting portions) are adjusted based on the results of the preliminary drop test. Such a drop test is repeated one or more times and the respective shapes of the fitting portions are adjusted for each drop test.

On the other hand, in the injection die for the covers of the ink ribbon cassette, one die is provided with cavities corresponding to a plurality of covers. Accordingly, the plurality of covers can be molded by injecting a synthetic resin into one injection die.

For example, assume that one injection die is provided with cavities A1 and A2 of the cover A, and another injection die is provided with a (single) cavity B1 of a shaft container B. In this case, it is necessary to adjust the injection die so that both combinations, i.e., a combination of the cover A1 and the shaft container B1 and a combination of the cover A2 and the shaft container B1, may pass the drop test.

In addition, there may be covers (e.g., C1 and C2) different from these covers in some cases. In such cases, it is time consuming to adjust an injection die for the fitting states of the fitting portions in all the combinations of the covers with the shaft container in the ink ribbon cassette. For this reason, it is effective that the covers and the shaft container are formed integrally with each other and molded by a single injection die, and a fitting state is adjusted only for the injection die.

Patent Document 1: JP-A-4-50259
Patent Document 2: JP-A-9-136464
Patent Document 3: JP-A-10-193760
Patent Document 4: JP-A-2005-47222

In recent years, along with downsizing of printers, ink ribbon cassettes attached to the printers have been downsized. If the ink ribbon cassette has a portion projecting from the surface thereof, such a portion may be likely to become an obstacle when the ink ribbon cassette is internally attached to the printer at a predetermined position. Thus, it is preferred that such a portion projecting outwardly from the ink ribbon cassette not be present.

SUMMARY OF THE INVENTION

The present invention has been made in view of this point and aims to provide an ink ribbon cassette that is small-sized and does not have a portion, such as a hinge or the like, projecting outwardly.

The present invention is an ink ribbon cassette characterized by including: a shaft container including a reel-out shaft holder having a reel-out shaft bearing journaling an ink ribbon reel-out shaft, an ink ribbon reel-in shaft holder having a reel-in shaft bearing journaling an ink ribbon reel-in shaft, and a pair of lateral bodies connecting the reel-out shaft holder with the reel-in shaft holder; a reel-out shaft holder cover adapted to cover the reel-out shaft holder of the shaft container; and a reel-in shaft holder cover adapted to cover the reel-in shaft holder of the shaft container; wherein the reel-out shaft holder cover is connected to the reel-out shaft holder via a first connecting body, the reel-in shaft holder cover is connected to the reel-in shaft holder cover via a second connecting body, and the first and second connecting bodies each have two or more hinges.

The invention is an ink ribbon cassette characterized in that each of the hinges of the first connecting body is designed not to project outwardly from an external surface of the first connecting body with the reel-out shaft holder cover closed relative to the reel-out shaft holder, and each of the hinges of the second connecting body is designed not to project outwardly from an external surface of the second connecting body with the reel-in shaft holder cover closed relative to the reel-in shaft holder.

The invention is an ink ribbon cassette characterized in that a vertical cross-section formed by the reel-out shaft holder cover, the first connecting body, and the reel-out shaft holder becomes a general circular arc with the reel-out shaft holder cover closed relative to the reel-out shaft holder, and a vertical cross-section formed by the reel-in shaft holder cover, the second connecting body, and the reel-in shaft holder becomes a general circular arc with the reel-in shaft holder cover closed relative to the reel-in shaft holder.

The invention is an ink ribbon cassette characterized in that each of the first and second connecting bodies has two hinges, and the two hinges are respectively provided at both ends of the first connecting body and of the second connecting body.

The invention is an ink ribbon cassette characterized in that each of the first and second connecting bodies has three hinges, and the three hinges are respectively provided at both ends and a center of the first connecting body and of the second connecting body.

The invention is an ink ribbon cassette characterized in that the shaft container, the reel-out shaft holder cover, the reel-in shaft holder cover, the first connecting member and the second connecting member are integrally molded from synthetic resin.

The invention is an ink ribbon cassette characterized in that the synthetic resin contains styrene-butadiene block copolymer and polystyrene.

The invention is an ink ribbon cassette characterized in that styrene-butadiene block copolymer and polystyrene are mixed with each other at a mixture ratio of approximately 1:1 to 1:3.

The invention is an ink ribbon cassette characterized in that a guide member is provided at an end of the reel-in shaft holder cover so as to be abutted against and guide the ink ribbon with the reel-in shaft holder cover closed relative to the reel-in shaft holder.

The invention is an ink ribbon cassette characterized in that the guide member is formed integrally with the reel-in shaft holder cover.

The invention is an ink ribbon cassette characterized in that the guide member has an abutment surface abutted against the ink ribbon and the abutment surface includes an arcuate profile in cross-section.

The invention is an ink ribbon cassette characterized in that the shaft container further includes a guide rod secured to the reel-in shaft holder and abutted against and guiding the ink ribbon.

The invention is an ink ribbon cassette characterized in that the guide rod is formed integrally with the reel-in shaft holder.

According to the present invention, in the state where the reel-out shaft holder cover is closed relative to the reel-out shaft holder and the reel-in shaft holder cover is closed relative to the reel-in shaft holder, since the ink ribbon cassette has no portions, such as hinges or the like, projecting outwardly therefrom, the ink ribbon cassette can be downsized.

In addition, according to the present invention, the shaft container, the reel-out shaft holder cover, the reel-in shaft holder cover, the first connecting member and the second connecting member are integrally molded from synthetic resin. Therefore, a labor hour taken to adjust fitting portions of an injection die in order to pass a drop test of the ink ribbon cassette can be reduced as described above.

Further, according to the present invention, the shaft container, the reel-out shaft holder cover, the reel-in shaft holder cover, the first connecting member and the second connecting member are integrally molded from the synthetic resin containing styrene-butadiene block copolymer and polystyrene. This can achieve a balance between the hinge performance of the hinge and the strength of the hinge.

DETAILED DESCRIPTION OF THE INVENTION

First Embodiment

Figure 1:
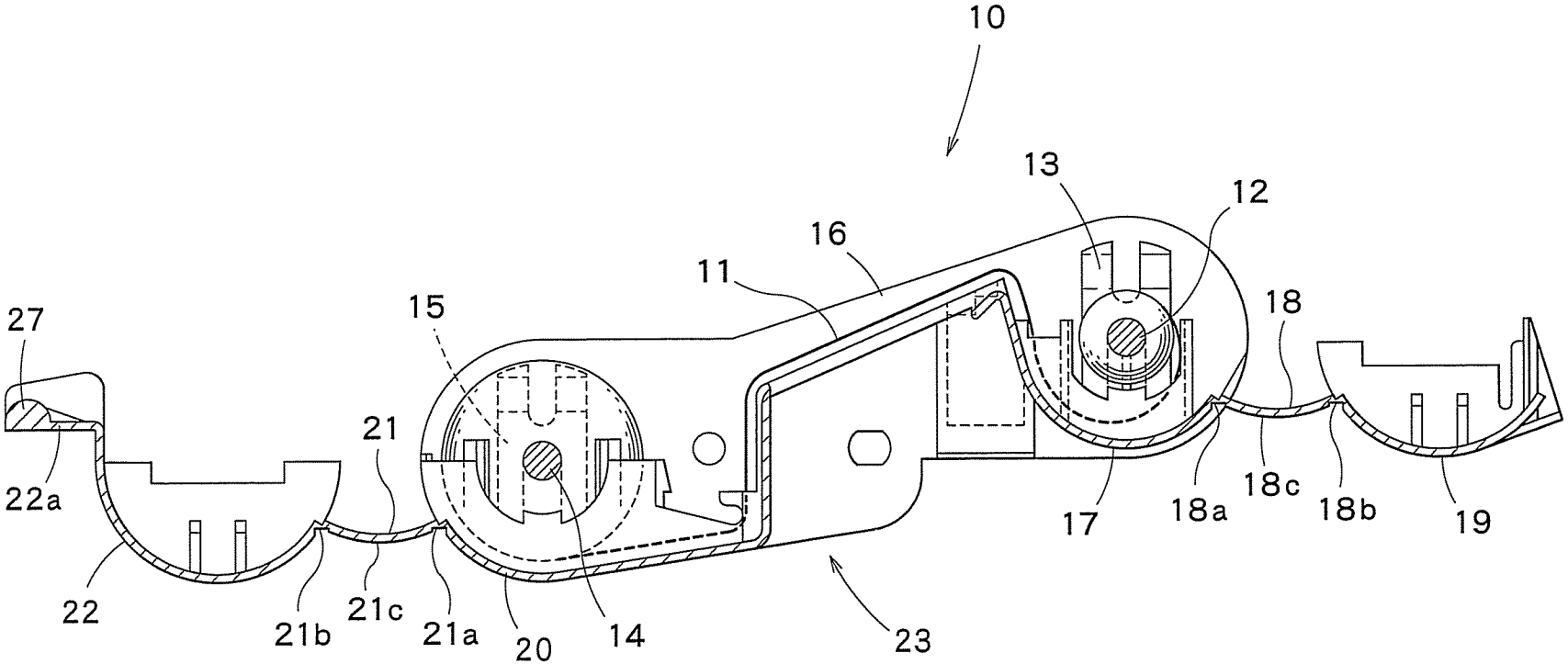
FIG. 1 is a cross-sectional view illustrating a first embodiment of an ink ribbon cassette according to the present invention.
Figure 2:
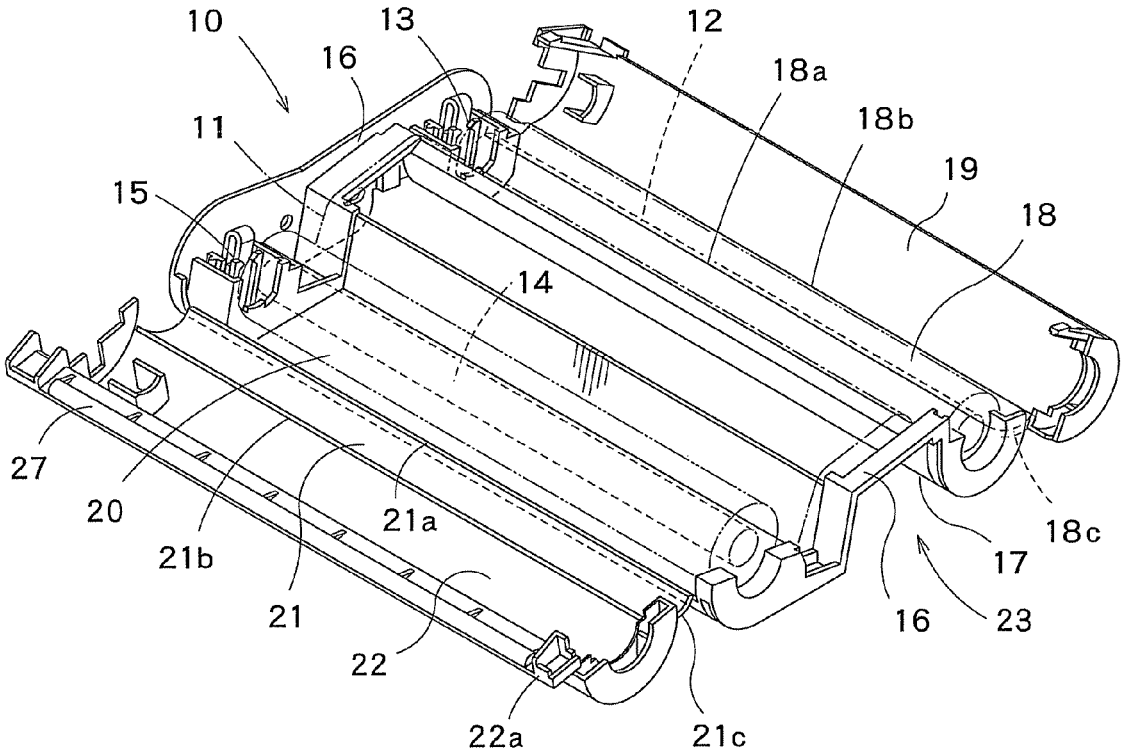
FIG. 2 is a perspective view illustrating the first embodiment of the ink ribbon cassette according to the present invention.
Figure 3:
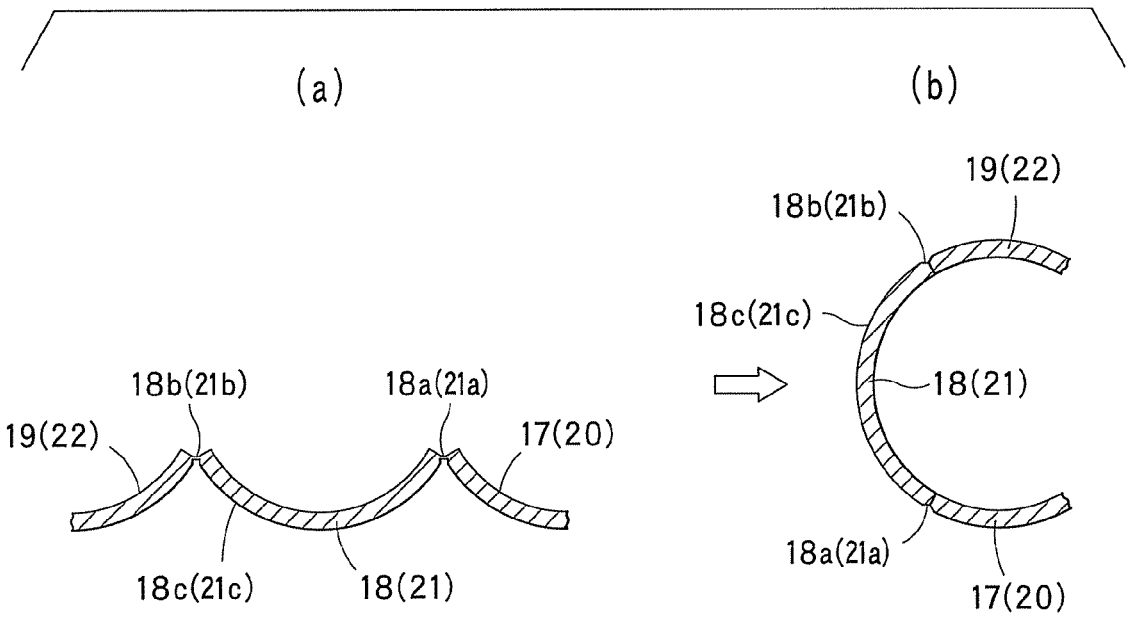
FIG. 3 is a schematic cross-sectional view illustrating operation of the ink ribbon cassette according to the present invention.
Figure 4:
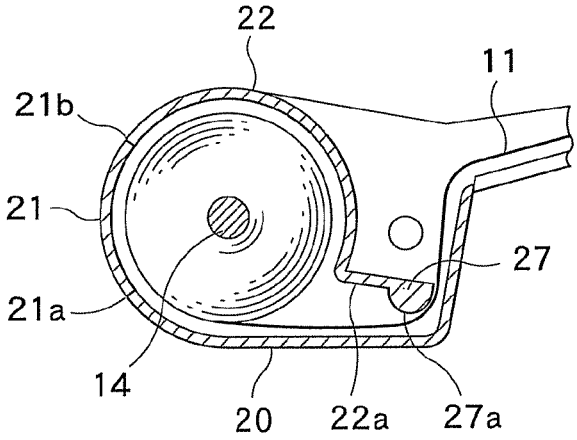
FIG. 4 is a partial cross-sectional view of a reel-in shaft holder in a state where a reel-in shaft holder cover is closed relative to the bearing cover.
Figure 5:
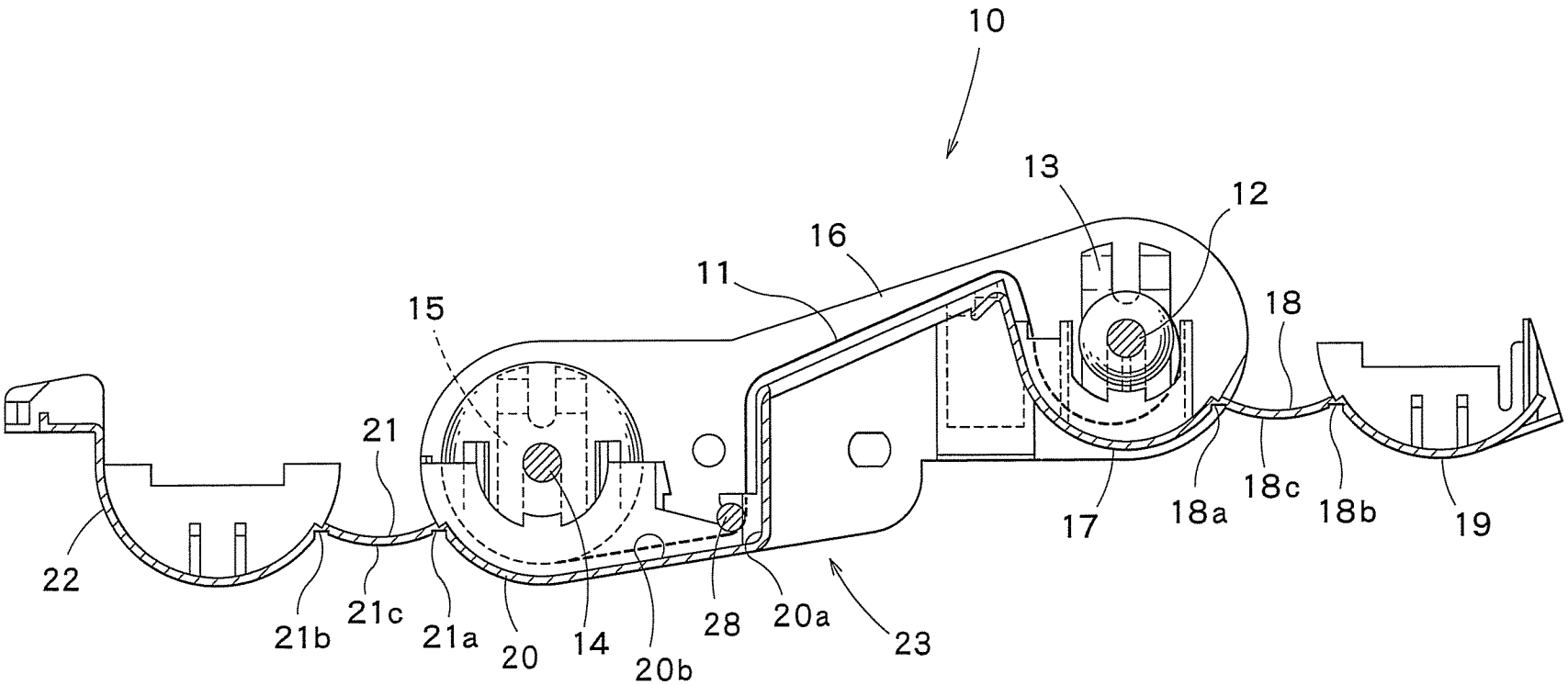
FIG. 5 is a cross-sectional view of a modification of the first embodiment of the ink ribbon cassette according to the present invention.
Figure 6:
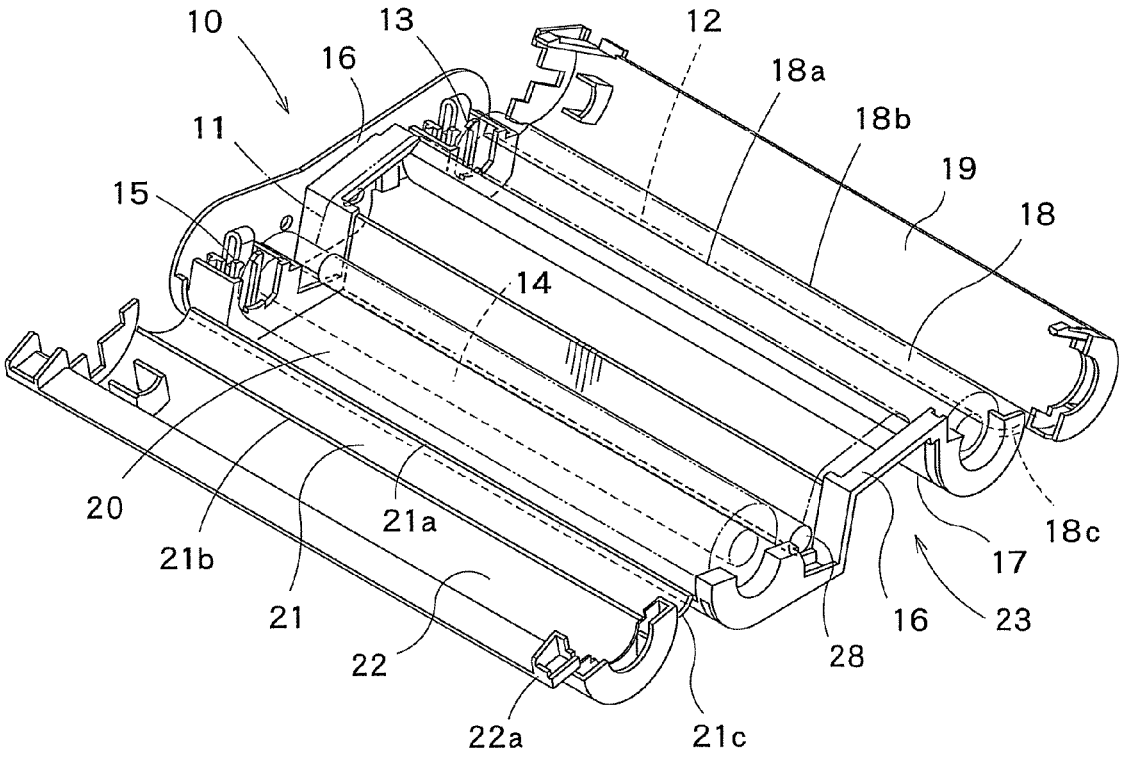
FIG. 6 is a perspective view of the modification of the first embodiment of the ink ribbon cassette according to the present invention.

A first embodiment of the present invention will hereinafter be described with reference to FIGS. 1 through 6. FIG. 1 is a cross-sectional view illustrating the first embodiment of the invention. FIG. 2 is a perspective view illustrating the first embodiment of the invention. FIG. 3(*a*) is a cross-sectional view illustrating a state where a reel-out shaft holder cover (a reel-in shaft holder cover) of a shaft container is opened relative to a reel-out shaft holder (a reel-in shaft holder). FIG. 3(*b*) is a cross-sectional view illustrating a state where the reel-out shaft holder cover (the reel-in shaft holder cover) of the shaft container is closed relative to the reel-out shaft holder (the reel-in shaft holder). FIG. 4 is a partial cross-sectional view of the reel-in shaft holder in a state where the reel-in shaft holder cover is closed relative to the reel-in shaft holder. FIG. 5 is a cross-sectional view of a modification of the first embodiment according to the invention. FIG. 6 is a perspective view illustrating the modification of the first embodiment.

A description is first given of an ink ribbon cassette according to the present embodiment with reference to FIGS. 1 through 4.

Referring to FIGS. 1 and 2, an ink ribbon cassette 10 is provided with a shaft container 23. This shaft container 23 includes a reel-out shaft holder 17, a reel-in shaft holder 20 and a pair of lateral bodies 16. The reel-out shaft holder 17 has a reel-out shaft bearing 13 that journals an ink ribbon reel-out shaft 12 that winds an ink ribbon 11 therearound. The reel-in shaft holder 20 has a reel-in shaft bearing 15 that journals an ink ribbon reel-in shaft 14 that secures one end of the ink ribbon 11. The lateral bodies 16 connect the reel-out shaft holder 17 and the reel-in shaft holder 20. In addition, a reel-out shaft holder cover 19 covering the reel-out shaft holder 17 of the shaft container 23 is connected to the reel-out shaft holder 17 via a first connecting body 18. Further, a reel-in shaft holder cover 22 covering the reel-in shaft holder 20 of the shaft container 23 is connected to the reel-in shaft holder 20 via a second connecting body 21.

The shaft container 23, the reel-out shaft holder cover 19, the reel-in shaft holder cover 20, the first connecting body 18 and the second connecting body 21 are integrally molded from synthetic resin.

Preferably, this synthetic resin contains styrene-butadiene block copolymer comprising, e.g., Asaflex (trademark) and general-purpose polystyrene comprising, e.g., GPPS (General Purpose Polystyrene) resin. Of these, Asaflex (trademark) is a material with hinge performance and has a characteristic where even if bent it does not cause whitening or breakage. However, since Asaflex (trademark) is very soft, the ink ribbon cassette 10 becomes insufficient in rigidity if only Asaflex (trademark) is used as the material of the ink ribbon cassette 10. During the use of the ink ribbon cassette 10 in the printer, the ink ribbon cassette 10 is thus likely to be partially deformed. To prevent such deformation, Asaflex (trademark) is mixed with GPPS to increase the rigidity (hardness) of the ink ribbon cassette 10. In this case, it is preferred that a mixture ratio be such that Asaflex (trademark): GPPS=1:1 to 1:3.

The synthetic resin is not limited to the above one containing styrene-butadiene block copolymer and general-purpose polystyrene resin, and various known materials can be used for the synthetic resin. For example, basically any resin can be used as such synthetic resin as long as the resin can be used for injection molding. Especially, any one of widely-used and easily-available polyacetal resin (POM resin), polystyrene resin (PS resin) and ABS resin can be used.

The first connecting body 18 is provided with hinges 18*a* and 18*b* at its both ends, and the second connecting body 21 is provided with hinges 21*a* and 21*b* at its both ends. While the first and second connecting bodies 18 and 21 have the two hinges 18*a* and 18*b*; and the two hinges 21*a* and 21*b*, respectively, as shown in FIGS. 1 and 2, each of the first and second connecting bodies 18 and 21 may have three hinges in total at both ends and at a center. Alternatively, each of the first and second connecting bodies 18 and 21 may have four or more hinges.

As shown in FIG. 3(*b*), the hinges 18*a* and 18*b* of the first connecting body 18 are each designed not to project outwardly from a first-connecting-body external surface 18*c* of the first connecting body 18 when the reel-out shaft holder cover 19 is closed relative to the reel-out shaft holder 17. Similarly, the hinges 21*a* and 21*b* of the second connecting body 21 are each designed not to project outwardly from a second-connecting-body external surface 21*c* of the second connecting body 21 when the reel-in shaft holder cover 22 is closed relative to the reel-in shaft holder 20.

As shown in FIGS. 1 and 2, the reel-in shaft holder cover 22 is provided at its distal end with a guide member 27. This guide member 27 is abutted against the ink ribbon 11 to guide it when the reel-in shaft holder cover 22 is closed relative to the reel-in shaft holder 20. The guide member 27 is located opposite the reel-in shaft holder 20 with respect to the ink ribbon 11 when the reel-in shaft holder cover 22 is closed relative to the reel-in shaft holder 20 (see FIG. 4). In FIGS. 1 and 2, the guide member 27 is integrally formed with the reel-in shaft holder cover 22 from synthetic resin.

As shown in FIGS. 1 and 2, the reel-in shaft holder cover 22 has a flat portion 22*a* extending along the width direction of the reel-in shaft holder cover 22. The guide member 27 is provided at the outermost end of the flat portion 22*a* of the reel-in shaft holder cover 22. As shown in FIG. 4, the guide member 27 is disposed to form a small clearance between the guide member 27 and the reel-in shaft holder 20 when the reel-in shaft holder cover 22 is closed relative to the reel-in shaft holder 20. Thus, when the ink ribbon 11 is reeled in toward the reel-in shaft holder 20, the ink ribbon 11 is guided around the ink ribbon reel-in shaft 14 while coming into contact only with the guide member 27.

As described above, the guide member 27 is adapted to guide the ink ribbon 11 from the ink ribbon reel-out shaft 12 toward the ink ribbon reel-in shaft 14. For this purpose, the guide member 27 has an abutment surface 27*a* abutted against the ink ribbon 11 (see FIG. 4). As shown in FIG. 4, in order for the abutment surface 27*a* of the guide member 27 to smoothly guide the ink ribbon 11, the abutment surface 27*a* includes an arcuate profile when viewed in a cross-section that extends along the moving direction of the ink ribbon 11 from the ink ribbon reel-out shaft 12 toward the ink ribbon reel-in shaft 14, i.e., in a cross-section perpendicular to the longitudinal direction of the guide member 27. In this way, the ink ribbon 11 can smoothly slide (slidably move) on the abutment surface 27*a* of the guide member 27 provided at the distal end of the reel-in shaft holder cover 22. As shown in FIG. 2, preferably, the guide member 27 is abutted against the ink ribbon 11 over the full width thereof along the axial center of the ink ribbon reel-in shaft 14. The reason is that the ink ribbon 11 can stably be guided by the guide member 27.

As described above, the guide member 27 is formed integrally with the reel-in shaft holder cover 22 at the flat portion 22*a* of the reel-in shaft holder cover 22. Therefore, the guide member 27 is of a simple structure and has high rigidity. Thus, the guide member 27 can stably and smoothly guide the ink ribbon 11. In addition, since the guide member 27 is of a simple structure, the production cost of the ink ribbon 10 can be suppressed to a low level.

In FIGS. 1 and 2, although the guide member is formed integrally with the reel-in shaft holder cover 22, the invention is not limited to this. The guide member 27 may be formed separately from the reel-in shaft holder cover 22 in advance, and thereafter the guide member 27 formed as a separate piece may be joined to the reel-in shaft holder cover 22.

A description is next given of the operation of the present embodiment configured as above.

As shown in FIGS. 1 and 2, the ink ribbon cassette 10 is integrally molded by an injection-type mold or die in the state where the reel-out shaft holder cover 19 is opened relative to the reel-out shaft holder 17 of the shaft container 23 and the reel-in shaft holder cover 22 is opened relative to the reel-in shaft holder 20.

A description is next given of the operation of attaching the ink ribbon reel-out shaft 12 winding the ink ribbon 11 therearound and the ink ribbon reel-in shaft 14 securing one end of the ink ribbon 11 to the inside of the ink ribbon cassette 10 integrally molded as describe above.

First, as shown in FIGS. 1 and 2, the reel-out shaft holder cover 19 and reel-in shaft holder cover 22 of the ink ribbon cassette 10 are opened. Next, the ink ribbon reel-out shaft 12 winding the ink ribbon 11 therearound and the ink ribbon shaft 14 securing one end of the ink ribbon 11 are attached to the ink ribbon cassette 10 in which the reel-out shaft holder cover 19 and the reel-in shaft holder cover 22 are opened as described above. In this case, the ink ribbon reel-out shaft 12 is rotatably inserted into the reel-out shaft bearing 13 of the reel-out shaft holder 17, and thereafter the ink ribbon reel-in shaft 14 is rotatably inserted into the reel-in shaft bearing 15 of the reel-in shaft holder 20.

The reel-out shaft holder cover 19 is next closed relative to the reel-out shaft holder 17 of the shaft container 23. In this case, interlocking with the reel-out shaft holder cover 19, the first connecting body 18 is turned around the hinges 18*a* and 18*b* to move toward the ink ribbon reel-out shaft 12.

Likewise, the reel-in shaft holder cover 22 is closed relative to the reel-in shaft holder 20 of the shaft container 23. In this case, interlocking with the reel-in shaft holder cover 22, the second connecting body 21 is turned around the hinges 21*a* and 21*b* to move toward the ink ribbon reel-in shaft 14.

Next, the operation of the reel-out shaft holder cover 19 when it is closed relative to the reel-out shaft bearing shaft 17 of the shaft container 23 is described in further detail by use of FIGS. 3(*a*) and 3(*b*).

As shown in FIG. 3(*a*), the hinge 18*a* of the first connecting body 18 is joined to the reel-out shaft holder 17 on the outside of the hinge 18*a* (on the side of the external surface 18*c* of the first connecting body 18) with the reel-out shaft holder cover 19 opened relative to the reel-out shaft holder 17. Similarly, the hinge 18*b* of the first connecting body 18 is joined to the reel-out shaft holder cover 19 on the outside of the hinge 18*b* (on the side of the external surface 18*c* of the first connecting body 18) with the reel-out shaft holder cover 19 opened relative to the reel-out shaft holder 17.

When the reel-out shaft holder cover 19 is then closed relative to the reel-out shaft holder 17, as described above, interlocking with the reel-out shaft holder cover 19, the first connecting body 18 is turned around the hinges 18*a* and 18*b* to move to the position shown in FIG. 3(*b*). In this case, the hinges 18*a* and 18*b* have no portions projecting outwardly from the first-connecting-body external surface 18*c*. Thus, a vertical cross-section of the reel-out shaft holder cover 19, the first connecting body 18, and the reel-out shaft holder 17 becomes a generally circular arc.

The operation described above applies also to the case where the reel-in shaft holder cover 22 is closed relative to the reel-in shaft holder 20 of the shaft container 20.

A description is next given of a modification of the ink ribbon cassette 10 of the present invention with reference to FIGS. 5 and 6. The ink ribbon cassette 10 shown in FIGS. 5 and 6 is such that a guide rod 28 adapted to guide the ink ribbon 11 is provided on the reel-in shaft holder 20. The other configurations are generally similar to the embodiment shown in FIGS. 1, 2 and 4. In FIGS. 5 and 6, the same portions as those shown in FIGS. 1, 2 and 4 are denoted with like reference numerals, and detailed explanations therefor are omitted.

Referring to FIGS. 5 and 6, the shaft container 23 includes the guide rod 28 circular in cross-section. The guide rod 28 is secured above a bottom surface 20*b* of the reel-in shaft holder 20 and abutted against the ink ribbon 11 to guide it. The guide rod 28 is located on the side opposite the reel-in shaft holder 20 with respect to the ink ribbon 11 (see FIG. 5). Specifically, the guide rod 28 is disposed in the vicinity of a corner 20*a* of the reel-in shaft holder 20 which is closer to the reel-out shaft holder 17 so as to form a clearance between the guide rod 28 and the reel-in shaft holder 20 for guiding the ink ribbon 11.

The guide rod 28 may be formed integrally with the reel-in shaft holder 20. Alternatively, the guide rod 28 may previously be formed as a separate part and then secured above the bottom surface 20*b* of the reel-in shaft holder 20. Further alternatively, the guide rod 28 may be molded integrally with the reel-in shaft holder cover 22.

Figure 10:
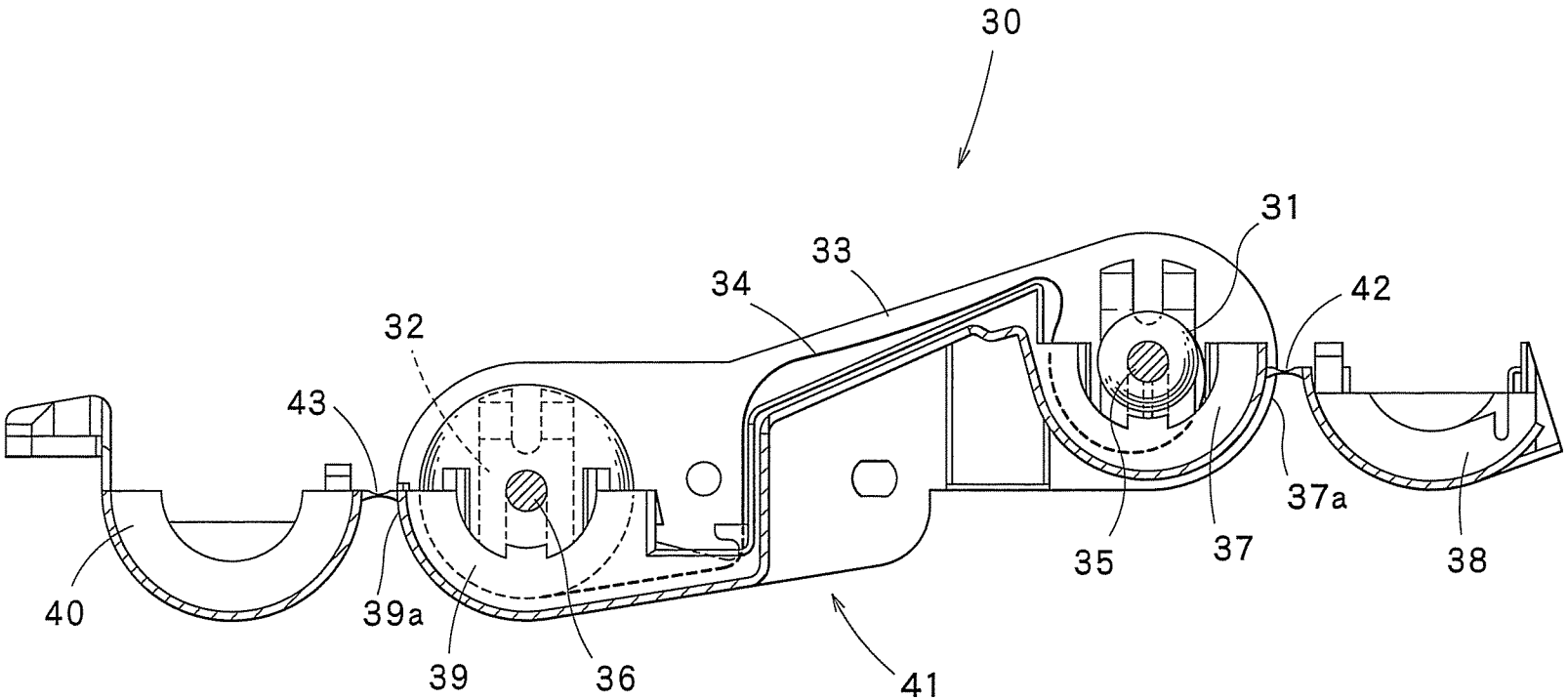
FIG. 10 is a cross-sectional view illustrating an ink ribbon cassette as a comparative example.
Figure 11:
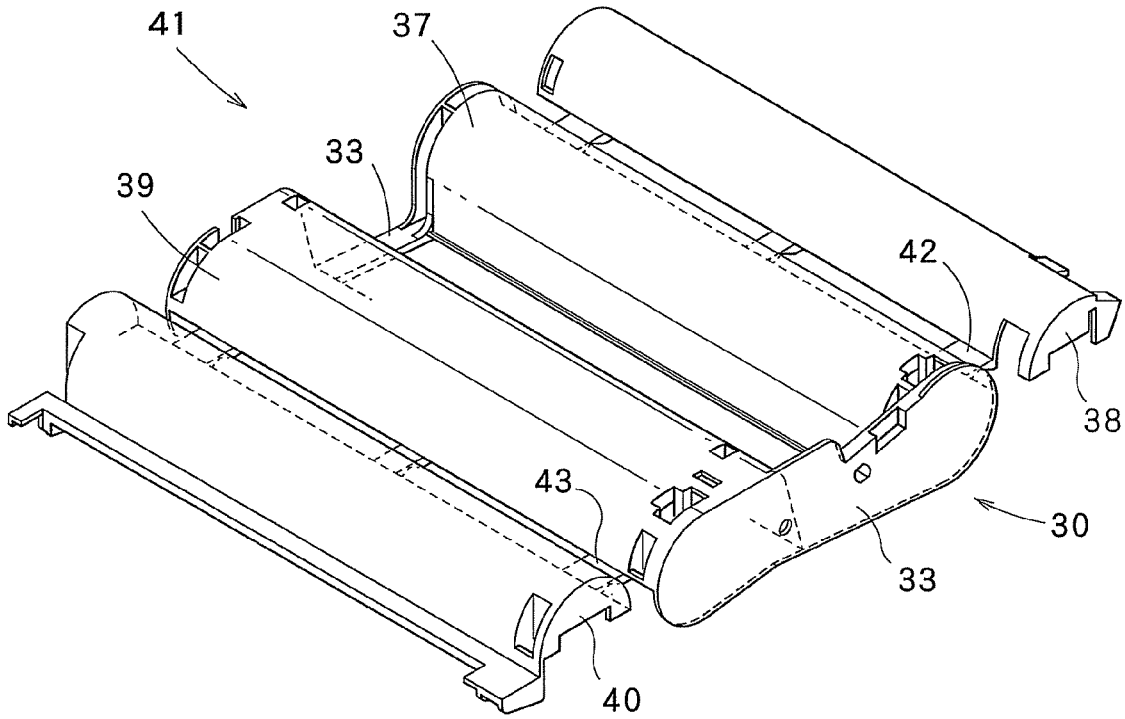
FIG. 11 is a perspective view illustrating the ink ribbon cassette as the comparative example.
Figure 12:
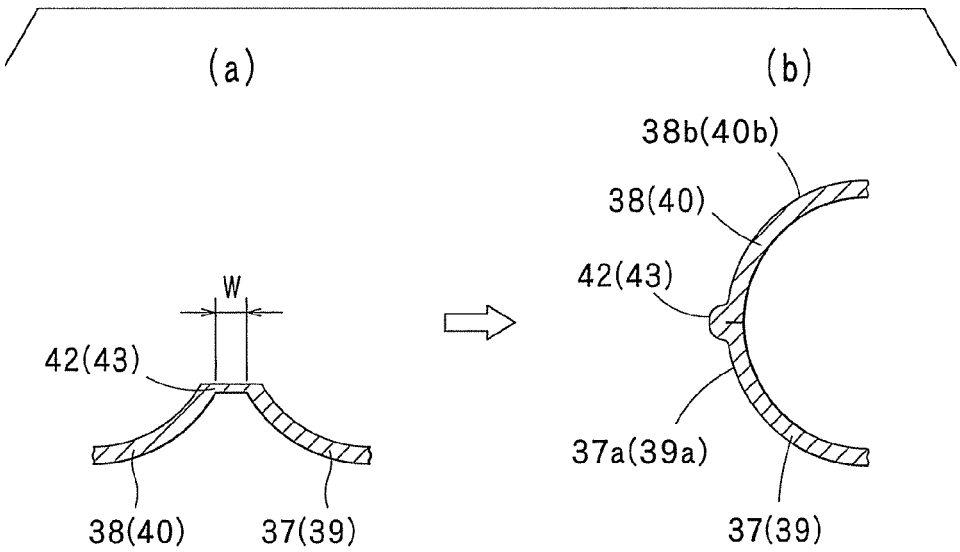
FIG. 12 is a schematic cross-sectional view illustrating operation of the ink ribbon cassette as the comparative example.

A description is next given of an integrally molded ink ribbon cassette by way of comparative example with reference to FIGS. 10 through 12.

Referring to FIGS. 10 and 11, an ink ribbon cassette 30 is provided with a shaft container 41. This shaft container 41 includes a reel-out shaft holder 37, a reel-in shaft holder 39 and a pair of lateral bodies 33. The reel-out shaft holder 37 has a reel-out shaft bearing 31 that journals an ink ribbon reel-out shaft 35 winding an ink ribbon 34 therearound. The reel-in shaft holder 39 has a reel-in shaft bearing 32 that journals an ink ribbon reel-in shaft 36 securing one end of the ink ribbon 34. The lateral bodies 33 connect the reel-out shaft holder 37 with the reel-in shaft holder 39. In addition, a reel-out shaft holder cover 38 covering the reel-out shaft holder 37 of the shaft container 41 is connected to the reel-out shaft holder 37 via a thin-walled section 42. In addition, a reel-in shaft holder cover 40 covering the reel-in shaft holder 39 of the shaft container 41 is connected to the reel-in shaft holder 39 via a thin-walled section 43.

In this case, as shown in FIG. 12(*a*), the shaft container 41 has the thin-walled section 42 formed between the reel-out shaft holder 37 and the reel-out shaft holder cover 38 so as to be integral with the reel-out shaft holder 37 and with the reel-out shaft holder cover 38. The thin-walled section 42 is thin-walled to have a thickness smaller than that of the reel-out shaft holder 37 and of the reel-out shaft holder cover 38 and has a certain width W.

Likewise, the shaft container 41 has the thin-walled section 43 formed between the reel-in shaft holder 39 and the reel-in shaft holder cover 40 so as to be integral with the reel-in shaft holder 39 and with the reel-in shaft holder cover 40. The thin-walled section 43 is thin-walled to have a thickness smaller than that of the reel-in shaft holder 39 and of the reel-in shaft holder cover 40 and has a certain width W.

As shown in FIG. 12(*b*), when the reel-out shaft holder cover 38 covers the reel-out shaft holder 37 for closing, the reel-out shaft holder cover 38 is turned upward of the reel-out shaft holder 37 around the thinned-wall section 42. At this time, the thinned-wall section 42 is deformed as shown in FIG. 12(*b*) to project outwardly (leftward in FIG. 12(*b*)) from the front surface 38*b* of the reel-out shaft holder cover 38 and from the front surface 37*a* of the reel-out shaft holder 37.

Likewise, when the reel-in shaft holder cover 40 covers the reel-in shaft holder 39 for closing, the reel-in shaft holder cover 40 is turned upward of the reel-in shaft holder 39 around the thinned-wall section 43. At this time, the thinned-wall section 43 is deformed as shown in FIG. 12(*b*) to project outwardly (leftward in FIG. 12(*b*)) from the front surface 40*b* of the reel-in shaft holder cover 40 and from the front surface 39*a* of the reel-in shaft holder 39.

In contrast to this, according the present embodiment shown in FIGS. 1 through 6, the hinges 18*a* and 18*b* of the first connecting body 18 are made not to project outwardly from the first-connecting-body external surface 18*c* with the reel-out shaft holder cover 19 closed relative to the reel-out shaft holder 17 as described above. Similarly, the hinges 21*a* and 21*b* of the second connecting body 21 are made not to project outwardly from the second connecting body external surface 21*c* with the reel-in shaft holder cover 22 closed relative to the reel-in shaft holder 20 (see FIGS. 3(*a*) and 3(*b*)).

In the ink ribbon cassette 10 shown in FIGS. 1 through 6, it could be conceivable that without the first connecting body 18, the reel-out shaft holder 17 and the reel-out shaft holder cover 19 are directly coupled with each other via a single hinge not projecting outwardly as shown in FIG. 3(*b*). However, in this case, when the reel-out shaft holder cover 19 is opened relative to the reel-out shaft holder 17, it is difficult to sufficiently open the reel-out shaft holder cover 19 with respect to the reel-out shaft holder 17. In this case, it is also difficult to insert the ink ribbon reel-out shaft 12 into the reel-out shaft bearing 13.

Likewise, it could be conceivable that without the second connecting body 21, the reel-in shaft holder 20 and the reel-in shaft holder cover 22 are directly coupled with each other via a single hinge not projecting outwardly as shown in FIG. 3(*b*). However, in this case, when the reel-in shaft holder cover 22 is opened relative to the reel-in shaft holder 20, it is difficult to sufficiently open the reel-in shaft holder cover 22 with respect to the reel-in shaft holder 20. In this case, it is also difficult to inset the ink ribbon reel-in shaft 14 into the reel-in shaft bearing 15.

In addition, according to the present embodiment, the guide member 27 is provided at the end of the reel-in shaft holder cover 22 so as to be abutted against the ink ribbon 11 to guide it when the reel-in shaft holder cover 22 is closed relative to the reel-in shaft holder 20. Alternatively, the shaft container 23 includes the guide rod 28 that is secured above the bottom surface 20*b* of the reel-in shaft holder 20 and abutted against the ink ribbon 11 to guide it. Thus, the ink ribbon 11 supplied from the ink ribbon reel-out shaft 12 can stably be guided toward the ink ribbon reel-in shaft 14.

Second Embodiment

A second embodiment of the present invention is next described with reference to FIGS. 7 and 8.

Figure 7:
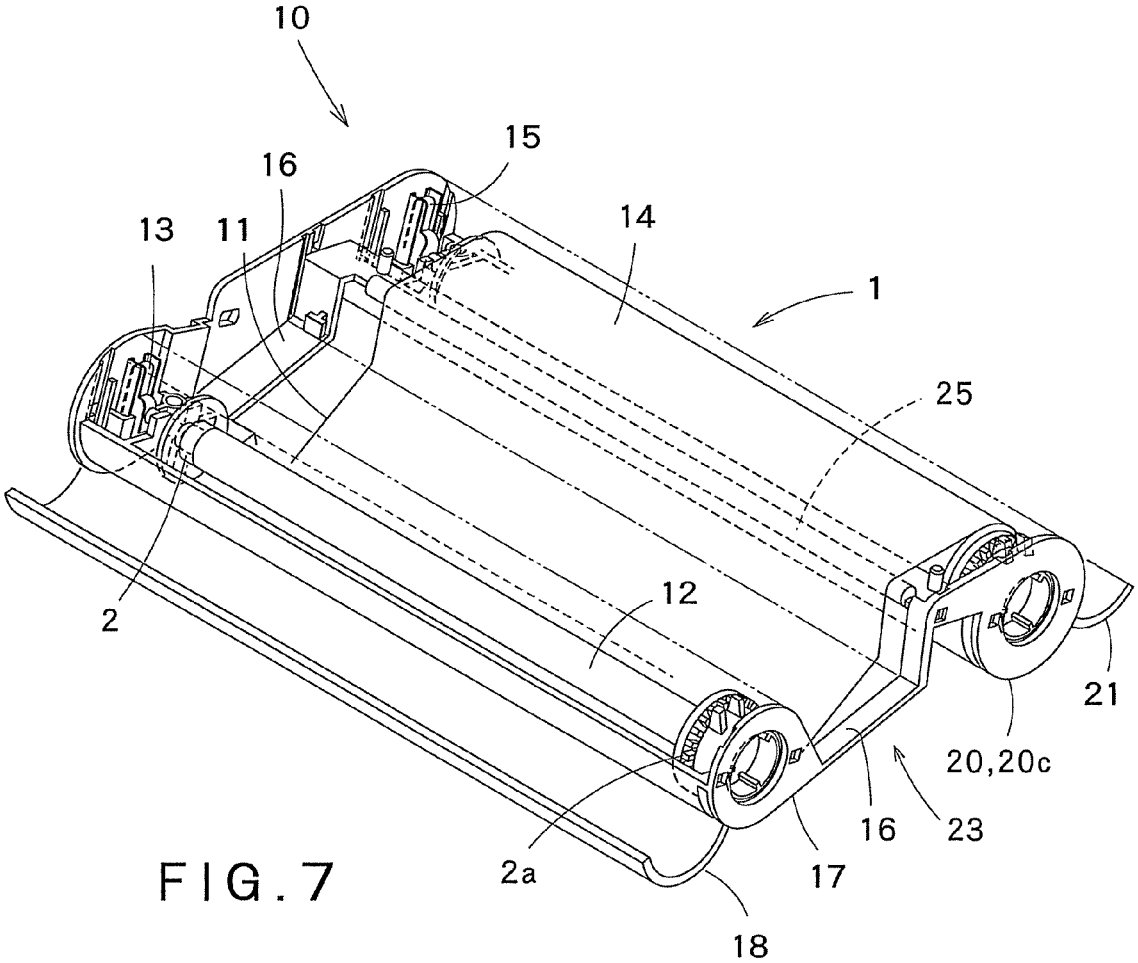
FIG. 7 is a perspective view illustrating a second embodiment of the ink ribbon cassette according to the present invention.

FIG. 7 is a perspective view illustrating the second embodiment of the invention. FIG. 8 illustrates a guide rod of a shaft container of an ink ribbon cassette of the second embodiment. The second embodiment shown in FIGS. 7 and 8 has an attachment position of the guide rod 25 different from that of the first embodiment, and the other configurations are generally similar to those of the first embodiment. In FIGS. 7 and 8, the same portions as in the first embodiment are denoted with like reference numerals and detailed explanations therefor are omitted.

Referring to FIG. 7, the shaft container 23 of the ink ribbon cassette 10 is provided with the guide rod 25. The guide rod 25 is secured to the reel-in shaft holder 20 and abutted against the ink ribbon 11 to guide it. The guide rod 25 is located on the side opposite a thermal head 5*b* of a printer 1 with respect to the ink ribbon 11 and on the same side as the reel-in shaft holder 20 with respect to the ink ribbon 11 (see FIG. 8). The guide rod 25 may be formed integrally with or separately from the reel-in shaft holder 20.

It is to be noted that the reel-out shaft holder cover 19 connected to the first connecting body 18 and the reel-in shaft holder cover 22 connected to the second connecting body 21 are omitted in FIG. 7 for the sake of simplicity.

The reel-in shaft holder 20 includes a barrel portion 20*c* extending along the ink ribbon reel-in shaft 14 journaled. The guide rod 25 is secured to the barrel portion 20*c* of the reel-in shaft holder 20. As shown in FIG. 7, the guide rod 25 extends along the barrel portion 20*c* of the reel-in shaft holder 20 and is connected to the barrel portion 20*c* along the full length thereof. As shown in FIG. 8, it is preferred that the guide rod 25 be disposed on or near an end 20*d*, of the barrel portion 20*c* of the reel-in shaft holder 20, closer to the reel-out shaft holder 17. This is because the ink ribbon 11 from the thermal head 5*b* can be guided without touching the reel-in shaft holder 20. In other words, the ink ribbon 11 can be guided from the thermal head 5*b* toward the ink ribbon reel-in shaft 14 while coming into contact only with the guide rod 25.

As described above, the guide rod 25 guides the ink ribbon 11 from the ink ribbon reel-out shaft 12 to the ink ribbon reel-in shaft 14. For this purpose, the guide member 25 has an abutment surface 26 abutted against the ink ribbon 11 (see FIG. 8). As shown in FIG. 8, in order to smoothly guide the ink ribbon 11, the abutment surface 26 of the guide member 25 includes an arcuate profile in a cross-section that extends along the moving direction of the ink ribbon 11 from the ink ribbon reel-out shaft 12 toward the ink ribbon reel-in shaft 14, i.e., in a cross-section perpendicular to the longitudinal direction of the guide rod 25. In this way, the ink ribbon 11 can smoothly slide (slidably move) on the abutment surface 26 of the guide rod 25 secured to the reel-in shaft holder 20. As shown in FIG. 7, preferably, the guide rod 25 is abutted against the ink ribbon 11 over the full width thereof along the axial center of the ink ribbon reel-in shaft 14. The reason is that the ink ribbon 11 can stably be guided by the guide rod 25.

When the width of the ink ribbon 11 along the ink ribbon reel-in shaft 14 is not less than 100 mm and not larger than 120 mm, it is preferred that the abutment surface 26 of the guide rod 25 have an arcuate profile in cross-section with a radius r not less than 1.5 mm and not greater than 5.0 mm, in light of ensuring a smooth slide of the ink ribbon 11. In the case where the width of the ink ribbon 11 along the ink ribbon reel-in shaft 14 is not less than 100 mm and not larger than 120 mm, if the radius r of the cross-sectional arcuate profile of the guide rod 25 is made less than 1.5 mm, the pressure applied to the guide rod 25 and to the ink ribbon 11 increases. As a result, the movement of the ink ribbon 11 from the ink ribbon reel-out shaft 12 to the ink ribbon reel-in shaft 14 becomes unstable, or intense abnormal noise occurs during movement of the ink ribbon 11. Further, in the case where the width of the ink ribbon 11 along the ink ribbon reel-out shaft 12 is not less than 100 mm and not larger than 120 mm, if the radius r of the cross-sectional arcuate profile of the guide rod 25 is made greater than 5.0 mm, the guide rod 25 may not be successfully accommodated in the ink ribbon cassette 10.

When the width of the ink ribbon 11 along the ink ribbon reel-in shaft 14 is not less than 100 mm and not larger than 120 mm, and the abutment surface 26 of the guide rod 25 has an arcuate profile in cross-section with a radius not less than 2.0 mm and not greater than 3.0 mm, a better slide can be ensured between the guide rod 25 and the ink ribbon 11 so that the ink ribbon 11 can more stably be guided. Especially, if the guide rod 25 contains styrene-butadiene block copolymer, it was found that setting the sectional shape of the guide rod 25 in such a way is effective. Styrene-butadiene block copolymer is superior in injection molding performance (productivity), impact strength, rigidity, sliding performance, and external appearance. Therefore, the ink ribbon 11 can more stably be guided by the guide rod 25.

The material of the guide rod 25 is not limited to styrene-butadiene block copolymer, and various known materials can be used for the guide rod 25. For example, any resin can be used as the material of the guide rod 25 as long as the resin can be used for injection molding. It is preferable in view of fabrication cost that such a material, especially, any one of widely-used and easily-available polyacetal resin (POM resin), polystyrene resin (PS resin) and ABS resin, be used to mold the guide rod 25 integrally with the reel-in shaft holder 20.

Figure 8:
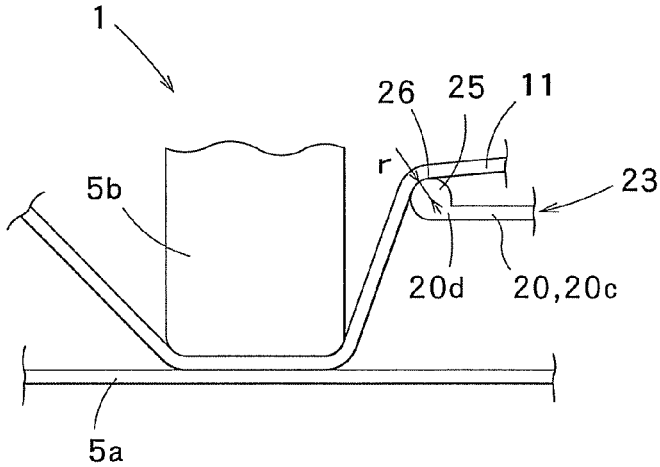
FIG. 8 illustrates a guide rod of a shaft container of an ink ribbon cassette according to the second embodiment of the present invention.
Figure 9:
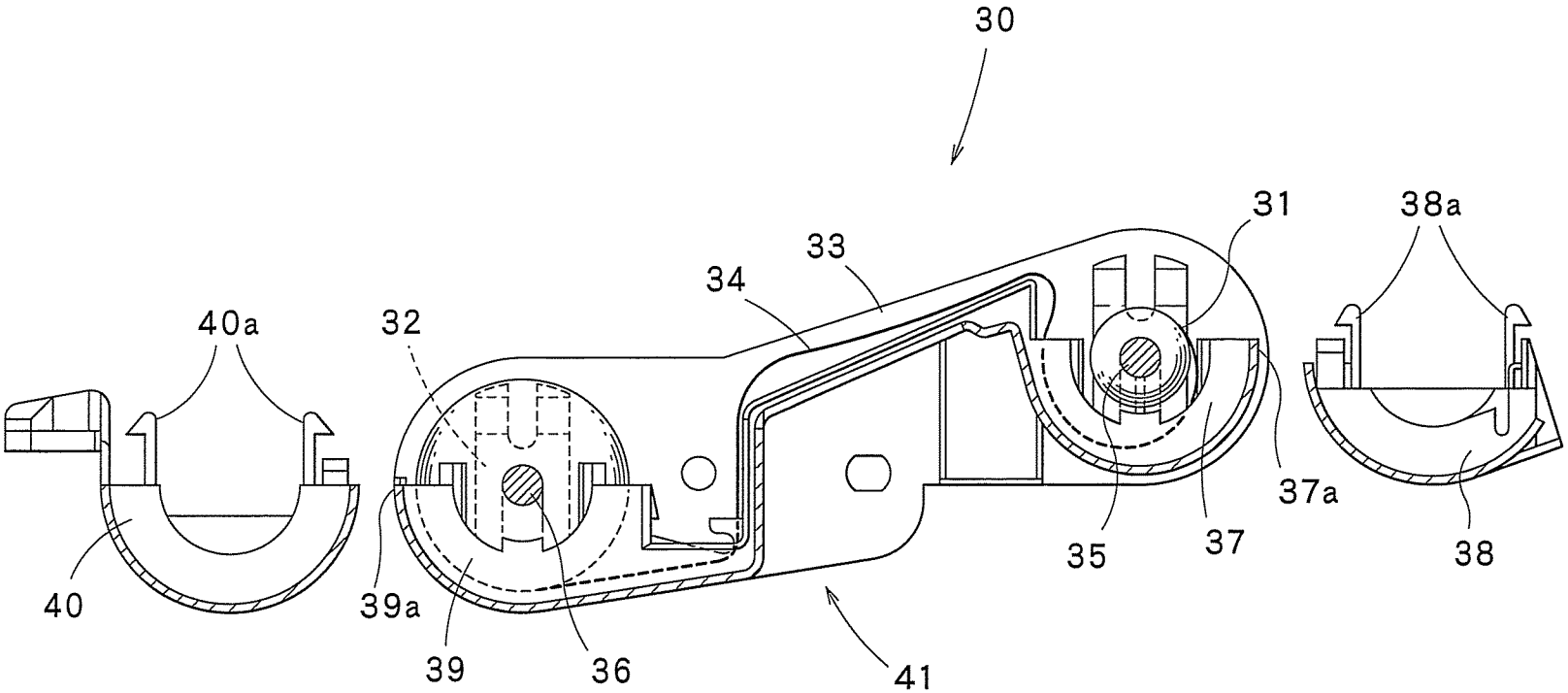
FIG. 9 is a cross-sectional view illustrating a conventional ink ribbon cassette.

In FIG. 8, while the ink ribbon cassette 10 is mounted to the printer 1, the ink ribbon 11 is heated by the thermal head 5*b* to transfer an image to a receiver sheet 5*a*. In this case, as shown in FIG. 8, the ink ribbon 11 supplied from the ink ribbon reel-out shaft 12 is moved to a position opposed to the thermal head 5*b*. Thereafter, while being abutted against and guided by the guide rod 25, the ink ribbon 11 is reeled in by the ink ribbon reel-in shaft 14.

As described above, according to the present embodiment, the reel-in shaft holder 20 includes the barrel portion 20*c* extending along the reel-in shaft holder 20, and the guide rod 25 is secured to the barrel body 20*c*. Therefore, the deformation of the guide rod 25 can be prevented by the barrel portion 20*c* of the reel-in shaft holder 20. Thus, the ink ribbon 11 can stably be guided by the guide rod 25 which is prevented from being deformed or slackened to a great extent. Especially in the present embodiment, the guide rod 25 extends along the barrel portion 20*c* of the reel-in shaft holder 20 and is joined to the barrel portion 20*c* over the full length thereof. In other words, the guide rod 25 is reinforced by the barrel portion 20*c* of the reel-in shaft bearing portion 20 over the full length thereof. Thus, the deformation of the guide rod 25 is drastically prevented, whereby the ink ribbon 11 can stably be guided.

Further, according to the present embodiment, the guide rod 25 is disposed on the end 20*d*, closer to the reel-out shaft holder 17, of the barrel portion 20*c* of the reel-in shaft holder 20 as shown in FIG. 8. Therefore, the ink ribbon 11 supplied from the ink ribbon reel-out shaft 12 can be reeled in around the ink ribbon reel-in shaft 14 from a position in contact with the thermal head 5*b* while being prevented from coming into contact with any part other than the guide rod 25. This can prevent the ink ribbon 11 from coming into contact with and from being caught by something, whereby the ink ribbon 11 can more stably be moved to the thermal head 5*b*.

Further, according to the present embodiment, the guide member 25 has the abutment surface 26, abutted against the ink ribbon 11, including the arcuate profile in cross-section extending along the moving direction of the ink ribbon 11 from the ink ribbon reel-out shaft 12 toward the ink ribbon reel-in shaft 14. Therefore, a slide between the guide rod 25 and the ink ribbon 11 can be made smooth. Thus, the ink ribbon 11 can stably be guided without being caught.

Further, according to the present embodiment (ex. FIG. 7), the guide rod 25 is abutted against the ink ribbon 11 over the full width of the ink ribbon 11 along the axial center of the ink ribbon reel-in shaft 14. Therefore, it is possible to prevent occurrence of local friction on the ink ribbon 11 between the guide rod 25 and the ink ribbon 11. Thus, the ink ribbon 11 can stably be guided without the ink ribbon 11 being twisted.

The invention claimed is:

1. An ink ribbon cassette comprising:

a shaft container including a reel-out shaft holder having a reel-out shaft bearing journaling an ink ribbon reel-out shaft, a reel-in shaft holder having a reel-in shaft bearing journaling an ink ribbon reel-in shaft, and a pair of lateral bodies connecting the reel-out shaft holder with the reel-in shaft holder;

a reel-out shaft holder cover adapted to cover the reel-out shaft holder of the shaft container; and a reel-in shaft holder cover adapted to cover the reel-in shaft holder of the shaft container;

wherein the reel-out shaft holder cover is connected to the reel-out shaft holder via a first connecting body;

wherein the reel-in shaft holder cover is connected to the reel-in shaft holder cover via a second connecting body;

wherein the first and second connecting bodies each have two or more hinges; and wherein a guide member is provided at an end of the reel-in shaft holder cover so that the guide member is in contact with and guides the ink ribbon when the reel-in shaft holder cover is closed relative to the reel-in shaft holder by turning the reel-in shaft holder upward;

wherein the reel-in shaft holder cover has a curved portion, and a flat portion extending from a distal end of the curved portion, and the guide member is provided at an outermost end of the flat portion: and wherein the guide member has an abutment surface abutted against the ink ribbon, and the abutment surface includes an arcuate profile in cross-section.

2. The ink ribbon cassette according to claim 1, wherein each of the hinges of the first connecting body is designed not to project outwardly from an external surface of the first connecting body with the reel-out shaft holder cover closed relative to the reel-out shaft holder, and each of the hinges of the second connecting body is designed not to project outwardly from an external surface of the second connecting body with the reel-in shaft holder cover closed relative to the reel-in shaft holder.

3. The ink ribbon cassette according to claim 2, wherein a vertical cross-section formed by the reel-out shaft holder cover, the first connecting body, and the reel-out shaft holder becomes a generally circular arc with the reel-out shaft holder cover closed relative to the reel-out shaft holder, and a vertical cross-section formed by the reel-in shaft holder cover, the second connecting body, and the reel-in shaft holder becomes a general circular arc with the reel-in shaft holder cover closed relative to the reel-in shaft holder.

4. The ink ribbon cassette according to claim 1, wherein each of the first and second connecting bodies has two hinges, and the two hinges are respectively provided at both ends of the first connecting body and of the second connecting body.

5. The ink ribbon cassette according to claim 1, wherein each of the first and second connecting bodies has three hinges, and the three hinges are respectively provided at both ends and a center of the first connecting body and of the second connecting body.

6. The ink ribbon cassette according to claim 1, wherein the shaft container, the reel-out shaft holder cover, the reel-in shaft holder cover, the first connecting member and the second connecting member are integrally molded from synthetic resin.

7. The ink ribbon cassette according to claim 6, wherein the synthetic resin contains styrene-butadiene block copolymer and polystyrene.

8. The ink ribbon cassette according to claim 7, wherein styrene-butadiene block copolymer and polystyrene are mixed with each other at a mixture ratio of approximately 1:1 to 1:3.

9. The ink ribbon cassette according to claim 1, wherein the guide member is formed integrally with the reel-in shaft holder cover.

10. The ink ribbon cassette according to claim 1, wherein the shaft container further includes a guide rod secured to the reel-in shaft holder and abutted against and guiding the ink ribbon.

11. The ink ribbon cassette according to claim 10, wherein the guide rod is formed integrally with the reel-in shaft holder.

* * * * *